US008884179B2

(12) United States Patent
Roberts et al.

(10) Patent No.: US 8,884,179 B2
(45) Date of Patent: Nov. 11, 2014

(54) TORCH FLOW REGULATION USING NOZZLE FEATURES

(75) Inventors: Jesse Roberts, Cornish, NH (US); Peter Twarog, West Lebanon, NH (US); Zheng Duan, Hanover, NH (US); Sung Je Kim, Lebanon, NH (US)

(73) Assignee: Hypertherm, Inc., Hanover, NH (US)

( * ) Notice: Subject to any disclaimer, the term of this patent is extended or adjusted under 35 U.S.C. 154(b) by 565 days.

(21) Appl. No.: 12/980,858

(22) Filed: Dec. 29, 2010

(65) Prior Publication Data

US 2012/0012560 A1 Jan. 19, 2012

Related U.S. Application Data

(60) Provisional application No. 61/365,202, filed on Jul. 16, 2010.

(51) Int. Cl.
*H05H 1/34* (2006.01)

(52) U.S. Cl.
CPC ..... *H05H 1/34* (2013.01); *H05H 2001/3457* (2013.01)
USPC ..... 219/121.51; 219/121.5

(58) Field of Classification Search
CPC ..... H05H 1/34; H05H 2001/3478; H05H 2001/3442; H05H 2001/3457; B23K 10/00
USPC ..... 219/121.39, 121.49, 121.5, 121.51, 75; 315/111.21; 313/231.41, 231.51
See application file for complete search history.

(56) References Cited

U.S. PATENT DOCUMENTS

| | | | | |
|---|---|---|---|---|
| 3,914,573 | A | 10/1975 | Muehlberger | |
| 5,897,059 | A | 4/1999 | Müller | |
| 6,069,339 | A | 5/2000 | McGrath et al. | |
| 6,084,199 | A | 7/2000 | Lindsay et al. | |
| 6,914,211 | B2 | 7/2005 | Brasseur et al. | |
| 7,326,874 | B2 | 2/2008 | Brasseur et al. | |
| 7,737,383 | B2 | 6/2010 | Hussary et al. | |
| 2004/0169018 | A1 * | 9/2004 | Brasseur et al. | 219/121.5 |
| 2006/0289396 | A1 * | 12/2006 | Duan | 219/121.5 |
| 2006/0289404 | A1 | 12/2006 | Hawley et al. | |
| 2010/0078408 | A1 | 4/2010 | Liebold et al. | |

FOREIGN PATENT DOCUMENTS

JP 62-176685 A * 8/1987

* cited by examiner

*Primary Examiner* — Geoffrey S Evans
(74) *Attorney, Agent, or Firm* — Proskauer Rose LLP

(57) ABSTRACT

A nozzle for a plasma arc torch includes a body having a first end and a second end. The nozzle also includes a plasma exit orifice located at the first end of the body. A flange is located at the second end of the body. The flange is adapted to mate with a corresponding consumable. The flange is configured to selectively block at least one gas passage in the corresponding consumable to establish a gas flow relative to the nozzle body.

35 Claims, 10 Drawing Sheets

TORCH FLOW REGULATION USING NOZZLE FEATURES

RELATED APPLICATIONS

This application claims the benefit of and priority to U.S. Provisional Application No. 61/365,202, filed Jul. 16, 2010, the entirety of which is hereby incorporated herein by reference.

TECHNICAL FIELD

The present invention relates generally to plasma arc cutting torches, and more particularly, to regulating torch flow using nozzle features.

BACKGROUND

Welding and plasma arc torches are widely used in the welding, cutting, and marking of materials. A plasma torch generally includes an electrode and a nozzle having a central exit orifice mounted within a torch body, electrical connections, passages for cooling, and passages for arc control fluids (e.g., plasma gas). Optionally, a swirl ring is employed to control fluid flow patterns in the plasma chamber formed between the electrode and nozzle. In some torches, a retaining cap can be used to maintain the nozzle and/or swirl ring in the plasma arc torch. The torch produces a plasma arc, a constricted ionized jet of a gas with high temperature and high momentum. Gases used in the torch can be non-reactive (e.g., argon or nitrogen) or reactive (e.g., oxygen or air). In operation, a pilot arc is first generated between the electrode (cathode) and the nozzle (anode). Generation of the pilot arc can be by means of a high frequency, high voltage signal coupled to a DC power supply and the torch or by means of any of a variety of contact starting methods.

A plasma arc torch can be operated at several different current levels, for example, 65 Amps, 85 Amps or 105 Amps. A plasma arc torch that operates at 105 Amps requires a higher flow rate than a plasma arc torch that operates at 65 Amps. Due to the varying cooling flow and/or shield flow rates that are required to operate a plasma arc torch at different current levels, different consumables are needed for operation at each current level. Furthermore, different consumables may be needed when other operating parameters of the torch are adjusted, for example, amperage, material type or application.

One common reason for the premature failure of consumables or poor consumable performance is the incorrect matchup of consumables. Using the correct consumables and matching them together appropriately is necessary to achieve optimal cutting performance. However, it is cumbersome for both distributors and end users to stock and keep track of multiple consumable configurations. Moreover, operators have to cross reference the consumable part number listed on the consumables with the consumables that are listed in the operator's manual.

SUMMARY OF THE INVENTION

A need, therefore, exists to minimize the required number of consumables, for example, nozzles, swirl rings, and retaining caps, which are required for various different plasma arc torch parameters (e.g., shield flow and/or cooling flow rates, amperage, material type or application). Consumable part commonality can reduce the amount of time operators spend determining which consumable combination is correct for specific plasma torch parameters. Also, the total operating cost of a plasma arc torch will decrease because the probability that consumables will fail prematurely or perform poorly due to incorrect matchup of consumables will decrease because a single consumable can be used for many different torch parameters.

In one aspect, the invention features a nozzle for a plasma arc torch. The nozzle includes a body having a first end and a second end. The nozzle also includes a plasma exit orifice at the first end of the body. A flange is located at the second end of the body. The flange is adapted to mate with a corresponding consumable. The flange is configured to selectively block at least one gas passage in the corresponding consumable to establish a gas flow relative to the nozzle body.

In another aspect, the invention features a nozzle retaining cap for a plasma arc torch. The nozzle retaining cap includes a hollow body having a first end and a second end. The nozzle retaining cap also includes a protrusion located at the first end of the hollow body. A first hole pattern is formed in the protrusion. A second hole pattern is formed in the protrusion. The holes within at least one of the first or second hole patterns are sized to control at least one of a nozzle cooling gas flow or a plasma gas flow.

In another aspect, the invention features a torch tip for a plasma arc torch. The torch tip includes a nozzle mounted in a torch body of the plasma arc torch. The nozzle includes a nozzle body, a plasma exit orifice at a first end of the nozzle body, and a flange at a second end of the nozzle body. The torch tip also includes a consumable adapted to mate with the flange of the nozzle. The consumable has a surface at one end. The surface has a first hole pattern and a second hole pattern, wherein holes within at least one of the first or second hole patterns are sized to control at least one of a nozzle cooling gas flow or a plasma gas flow.

The invention, in a further aspect, features a swirl ring for a plasma arc torch. The swirl ring includes a hollow body having a wall, a first end and a second end. The swirl ring also includes an opening formed in the second end of the hollow body for mating with a nozzle within the plasma arc torch. A first hole pattern is formed in the wall of the body. The first hole pattern is positioned and sized to provide a first gas flow characteristic about a surface of the nozzle. A second hole pattern is formed in the wall of the body. The second hole pattern is positioned and sized to provide a second gas flow characteristic about the surface of the nozzle.

In another aspect, the invention features a method of establishing a shield gas flow in a plasma arc torch. The torch includes a retaining cap having a plurality of gas passages extending therethrough for providing the shield gas flow. The method includes providing a nozzle with an outer surface, a plasma exit orifice at a forward end and a radial flange at a rearward end. The method also includes aligning the radial flange of the nozzle relative to the plurality of gas passages disposed in the retaining cap, such that the radial flange of the nozzle selectively blocks at least one gas passage disposed in the retaining cap to establish the shield gas flow along the outer surface of the nozzle.

In a further aspect, the invention features a method of establishing a gas flow in a plasma arc torch. The method includes providing a nozzle having a body with an inner and an outer surface, a plasma exit orifice at a forward end of the body and a flange at a rearward end of the body. The method also includes aligning the flange of the nozzle relative to a plurality of gas passages of a consumable, such that the flange selectively blocks at least one gas passage to thereby establish a gas flow along at least one of the inner or the outer surface of the nozzle body.

In some embodiments the flange includes at least one of a contoured, tapered or castellated surface adapted to mate with or contact a mating surface of the corresponding consumable. The surface of the flange does not have to contact or touch the mating surface of the corresponding consumable. In some embodiments there is a tolerance, or small gap, between the surface of the flange and the mating surface of the corresponding consumable. The flange can be disposed relative to an exterior surface of the nozzle and can be radially disposed relative to a longitudinal axis extending through the nozzle body. In some embodiments, the flange is selectively contoured to regulate at least one of a shield gas flow about an exterior surface of the nozzle body or a plasma gas flow about an interior surface of the nozzle body.

The flange can form a step disposed relative to an exterior surface of the nozzle and radially disposed relative to a longitudinal axis extending through the nozzle body. The step can regulate a shield gas flow about an exterior surface of the nozzle body.

In some embodiments, the flange is an extension axially disposed relative to a longitudinal axis extending through the nozzle body. The extension can regulate a plasma gas flow about an interior surface of the nozzle body.

The nozzle can also include a step disposed relative to an exterior surface of the nozzle and radially disposed relative to a longitudinal axis extending through the nozzle body. The step can regulate a shield gas flow about an exterior surface of the nozzle body.

In some embodiments, the corresponding consumable is one of a swirl ring or a retaining cap.

In some embodiments, the first hole pattern and the second hole pattern are concentric circles. The first hole pattern can have a first diameter relative to a central longitudinal axis extending through the body and the second hole pattern can have a second diameter relative to the central longitudinal axis extending through the body.

A surface of the protrusion can be configured to receive a flange disposed on a body of a nozzle. The flange can be sized to block the gas from flowing through one of the first or second hole patterns. In some embodiments, the surface of the protrusion is configured to receive a flange disposed on a body of a nozzle and the flange is sized to allow the gas to flow through at least the second hole pattern to cool the nozzle. The surface of the protrusion can be configured to receive a flange disposed on a body of a nozzle and the flange can be sized to allow the gas to flow through the first and second hole patterns to cool the nozzle. In some embodiments, the surface of the protrusion is configured to receive a flange disposed on a body of a nozzle and the flange is sized to operate the plasma arc torch at a corresponding cutting parameter.

In some embodiments, the first hole pattern has the same number of gas passages as the second hole pattern. The first hole pattern can have a different number of gas passages as the second hole pattern.

In some embodiments, the first hole pattern is positioned and sized to provide the first gas flow when the plasma arc torch is operating at a first cutting parameter and the second hole pattern is positioned and sized to provide the second gas flow when the plasma arc torch is operating at a second cutting parameter. The first hole pattern can differ from the second hole pattern in at least one of a size of the holes, a shape of the holes, a number of holes, or a tangential angle of the holes. In some embodiments the first hole pattern has a different number of gas passages as the second hole pattern.

A flange disposed on a body of the nozzle can be sized to block a gas flow through the second hole pattern. In some embodiments, a flange disposed on a body of the nozzle can be sized to allow a gas to flow through at least the second hole pattern. The flange can be sized to allow the gas to flow through the first and second hole patterns.

In some embodiments, the opening is configured to receive a first nozzle having a first flange or a second nozzle having a second flange. The first flange of the first nozzle can be dimensioned to correspond to the first hole pattern and the second flange of the second nozzle can be dimensioned to correspond to the first and second hole patterns.

In some embodiments, the plurality of gas passages of the retaining cap comprise a first hole pattern and a second hole pattern. The flange of the nozzle can selectively block the first hole pattern or the second hole pattern. In some embodiments, the flange of the nozzle does not block the first or second hole patterns, allowing gas to flow through the first and second hole patterns. In some embodiments, the flange of the nozzle selectively blocks the first hole pattern, allowing gas to flow through the second hole pattern.

In some embodiments, the consumable (e.g., the swirl ring or the retaining cap) has a third hole pattern formed in the wall of the body. The third hole pattern can be positioned and sized to provide a third gas flow characteristic about the surface of the nozzle. The flange of the nozzle can selectively block none of the hole patterns, allowing gas to flow through all three hole patterns. In some embodiments, the flange of the nozzle can selectively block the first hole pattern, allowing gas to flow through the second and third hole patterns. The flange of the nozzle can selectively block the first and second hole patterns, allowing the gas to flow through the third hole pattern.

The method can also include removing the nozzle from the plasma arc torch. The method can further include providing a second nozzle with an outer surface, a plasma exit orifice at a forward end and a radial flange at a rearward end such that the radial flange of the second nozzle is different than the radial flange of the nozzle. In some embodiments, the method includes aligning the radial flange of the second nozzle relative to the plurality of gas passages disposed in the retaining cap, such that the radial flange of the second nozzle blocks at least two gas passages disposed in the retaining cap to establish a second shield gas flow along the outer surface of the second nozzle such that the second shield gas flow is different than the shield gas flow.

The flange can be a radial flange, the consumable can be a retaining cap and the gas flow can be a shield gas flow. In some embodiments, the flange is an axial flange, the consumable is a swirl ring and the gas flow is a plasma gas flow.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the invention.

DETAILED DESCRIPTION

Figure 1:
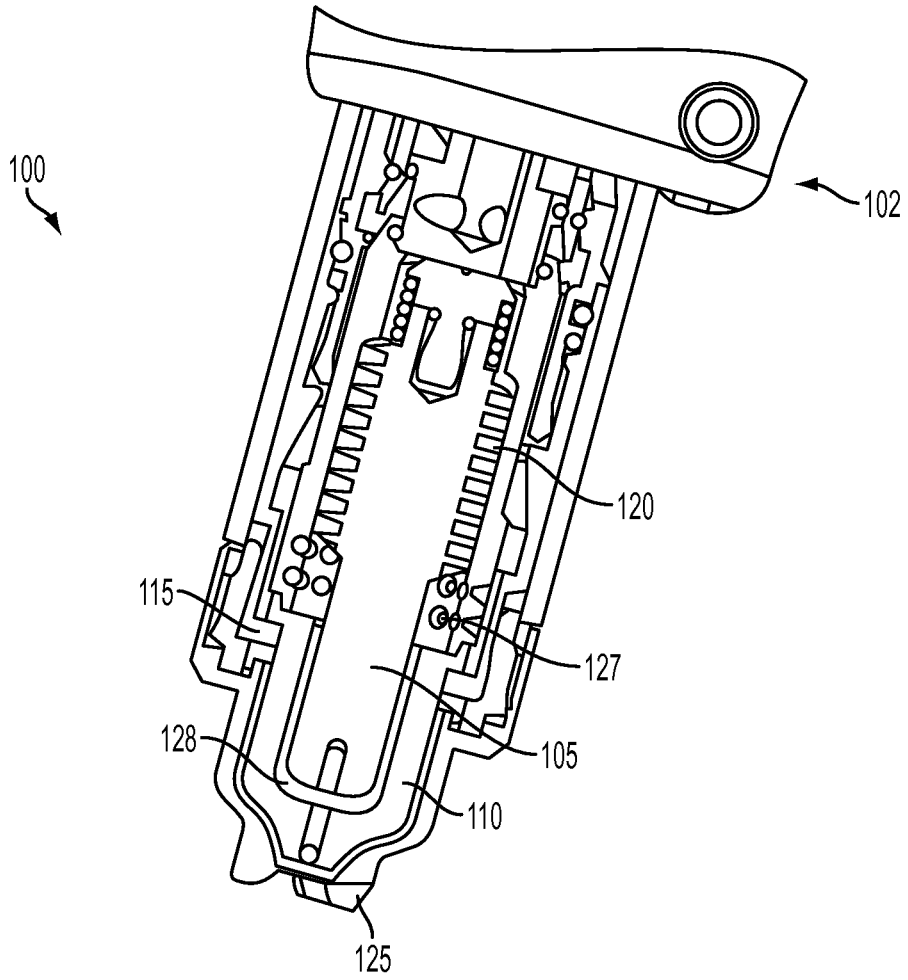
FIG. 1 is a cross-sectional view of a plasma arc torch tip.

FIG. 1 shows a cross-sectional view of a plasma arc torch 100. A plasma torch tip is comprised of a variety of different consumables, for example, an electrode 105, a nozzle 110, a retaining cap 115, a swirl ring 120, or a shield 125. The torch body 102 supports the electrode 105, which has a generally cylindrical body. The torch body 102 also supports the nozzle 110. The nozzle 110 is spaced from the electrode 105 and has a central exit orifice mounted within the torch body 102. The swirl ring 120 is mounted to the torch body 102 and has a set of radially offset (or canted) gas distribution holes 127 that impart a tangential velocity component to the plasma gas flow causing it to swirl. The shield 125, which also includes an exit orifice, is coupled (e.g., threaded) to the retaining cap 115. The retaining cap 115 is coupled (e.g., threaded) to the torch body 102. The torch and torch tip include electrical connections, passages for cooling, passages for arc control fluids (e.g., plasma gas), and a power supply.

In operation, the plasma gas flows through a gas inlet tube (not shown) and the gas distribution holes 127 in the swirl ring 120. From there, the plasma gas flows into the plasma chamber 128 and out of the torch through the exit orifice of the nozzle 110 and shield 125. A pilot arc is first generated between the electrode 105 and the nozzle 110. The pilot arc ionizes the gas passing through the nozzle exit orifice and the shield exit orifice. The arc then transfers from the nozzle 110 to the workpiece (not shown) for cutting the workpiece. It is noted that the particular construction details of the torch, including the arrangement of components, directing of gas and cooling fluid flows, and providing electrical connections can take a wide variety of forms.

Different cutting processes often require different shield and/or plasma gas flow rates, which, require different consumables. This leads to a wide variety of consumables being used in the field. Using the correct consumables and matching them together appropriately is necessary to achieve optimal cutting performance. Consumable mismatch (e.g., using a consumable that was made for torch operation at 65 Amps when then torch is being operated at 105 Amps) can result in poor consumable life or poor performance of the plasma arc torch.

Figure 2A:
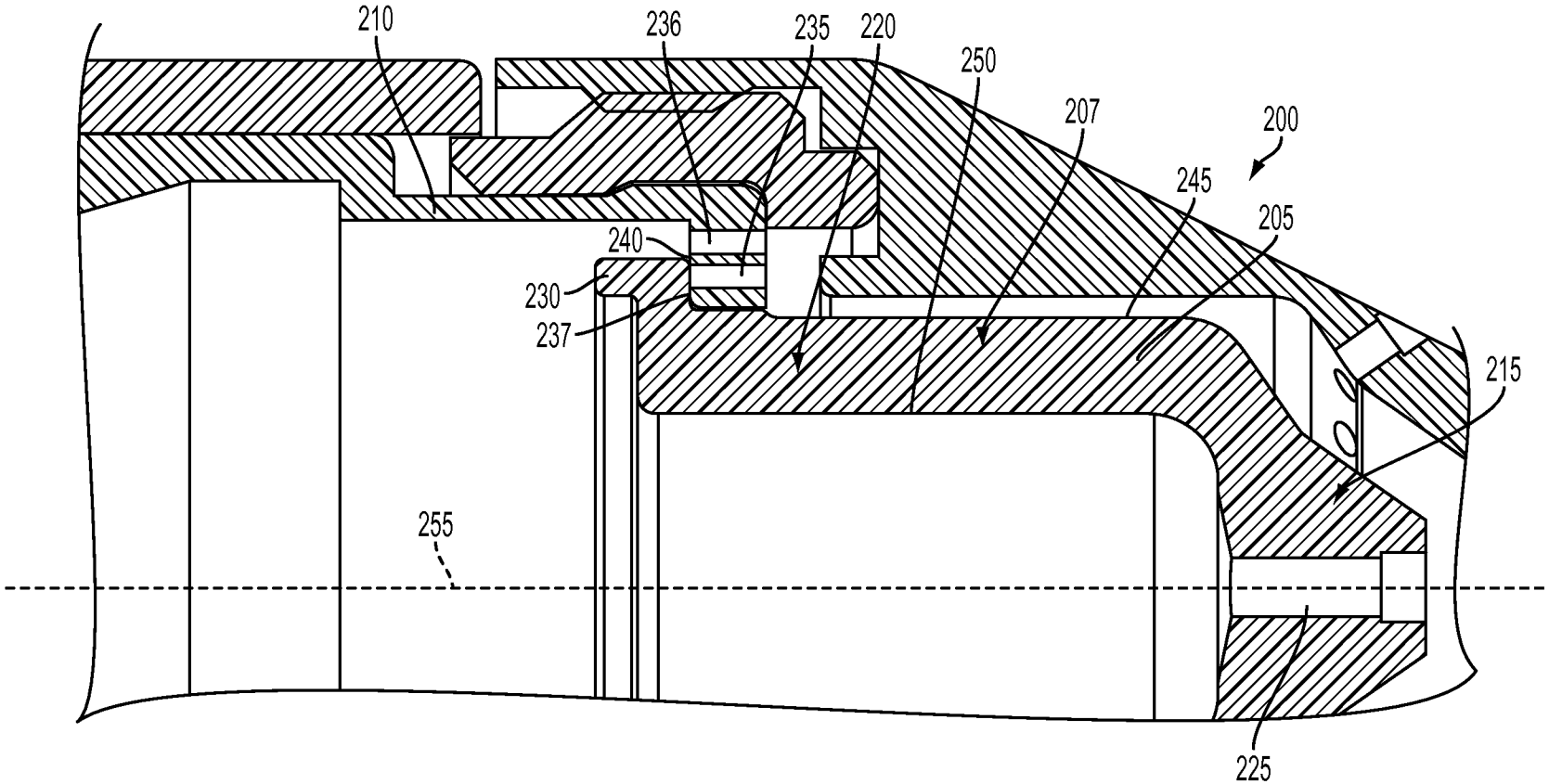
FIG. 2A is a cross-sectional view of a nozzle mated with a corresponding consumable, according to an illustrative embodiment of the invention.

FIG. 2A is a cross-sectional view of a torch tip 200 showing a nozzle 205 mated with a corresponding consumable 210, according to an illustrative embodiment of the invention. The corresponding consumable 210, in the embodiment shown in FIG. 2A is a retaining cap, however, in other embodiments, the corresponding consumable 210 can be a swirl ring. The nozzle 205 has a body 207, a first end 215 and a second end 220. A plasma exit orifice 225 is at the first end 215 of the nozzle body 207. A flange 230 is located at the second end 220 of the nozzle body 207. The flange 230 is adapted to mate with the corresponding consumable 210. The flange 230 is configured to selectively block at least one gas passage 235 in the corresponding consumable 210 to establish a gas flow relative to the nozzle body 207.

For example, the corresponding consumable 210 of FIG. 2A, has two gas passages 235, 236. The gas passages 235, 236 can be part of a pair of hole patterns that contain multiple gas passages. The flange 230 of FIG. 2A is configured to selectively block at least one gas passage, for example, gas passage 235. The flange 230 does not block gas passage 236, thus allowing shield gas to flow through gas passage 235 and along the exterior surface 245 of the nozzle body 207. This type of nozzle and consumable combination can be used with a plasma arc torch operating, for example, at about 65 Amps or about 85 Amps. Other operating currents are contemplated.

The flange 230 can have a variety of differently shaped and/or sized surfaces that can be used to establish varying gas flow relative to the nozzle body 207. For example, the flange 230 shown in FIG. 2A has a square or rectangular cross-section. In other embodiments, the flange can comprise at least one a contoured, tapered or castellated surface that is adapted to contact a mating surface of the corresponding consumable. For example, as shown in FIG. 2A, the contoured surface 237 of the flange 230 contacts a mating surface 240 of the corresponding consumable.

The particular size, shape and/or contour of the flange 230 can depend on the specific operating parameters of the plasma arc torch. In one embodiment, the flange 230 is selectively contoured to regulate at least one of a shield gas flow about an exterior surface 245 of the nozzle body 207 or a plasma gas flow about an interior surface 250 of the nozzle body 207.

The flange 230 can be disposed relative to the exterior surface 245 of the nozzle 205. The flange can also be radially disposed relative to a longitudinal axis 255 extending through the nozzle body 207. In some embodiments, the nozzle 205 also includes a step and in some embodiments, the flange 230 forms a step. The step can be disposed relative to the exterior surface 245 of the nozzle 205. The step can also be radially disposed relative to a longitudinal axis 255. The step can regulate a shield gas flow about an exterior surface 245 of the nozzle body 207.

Figure 2B:
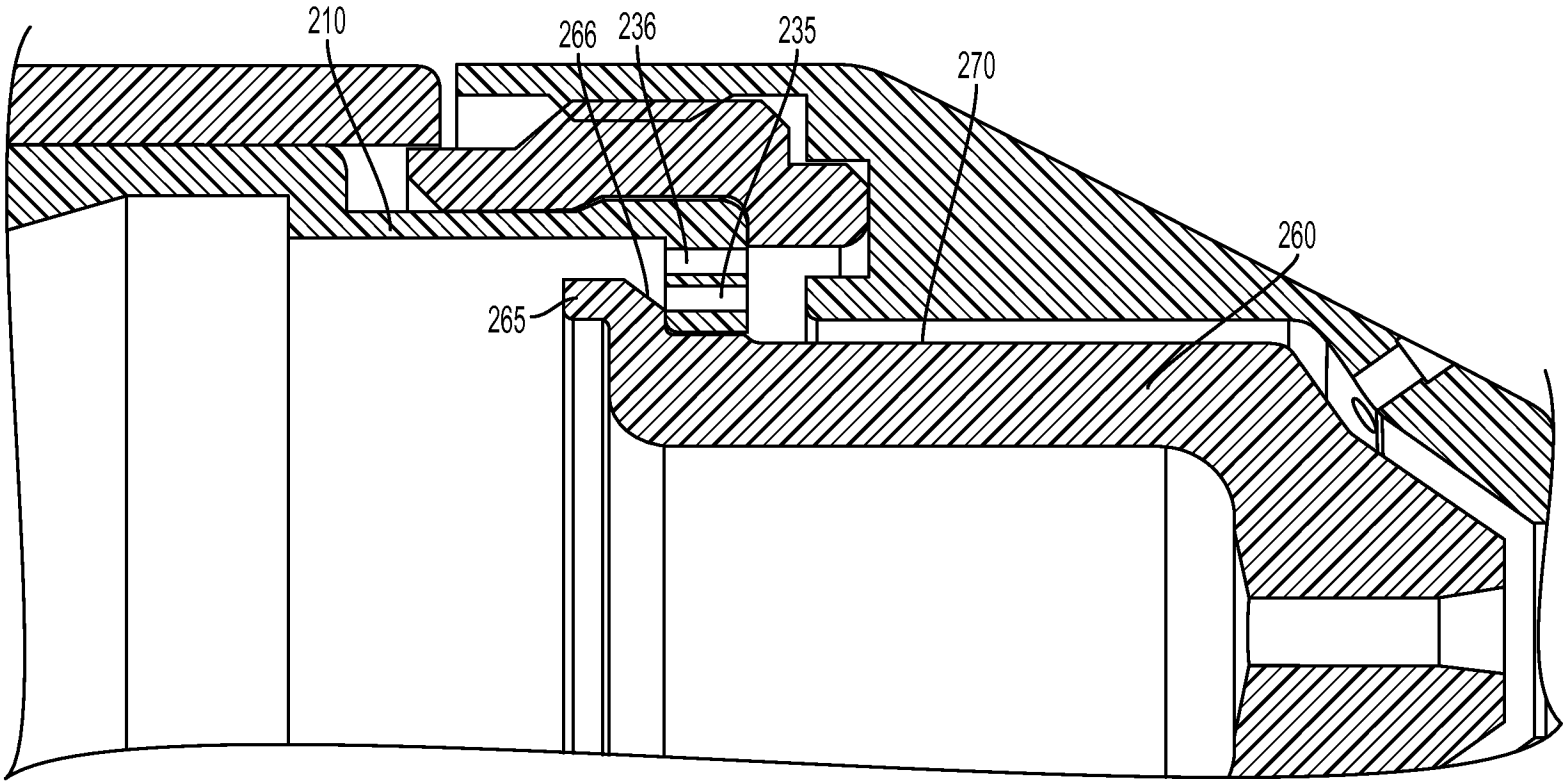
FIG. 2B is a cross sectional view of a nozzle mated with a corresponding consumable, according to an illustrative embodiment of the invention.

FIG. 2B is a cross sectional view of a nozzle 260 mated with a corresponding consumable 210, according to an illustrative embodiment of the invention. As discussed above with respect the FIG. 2A, the flange 230 of FIG. 2A does not block gas passage 236 thus allowing shield gas to flow through gas passage 235 and along the exterior surface 245 of the nozzle body 207. The nozzle and consumable combination of FIG. 2A can be used with a plasma arc torch operating, for example, at about 65 Amps or about 85 Amps.

The nozzle of FIG. 2B has a flange 265 that does not block either gas passage 235, 236. For example, as shown in FIG. 2B, the flange can have a tapered surface 266 that allows gas to flow through gas passages 235, 236. This allows an increased amount of gas to flow along the exterior surface 270 of the nozzle 260 as compared to the nozzle of FIG. 2A, providing increased cooling that can be necessary for a plasma arc torch operating, for example, at about 105 Amps.

Typically, an operator is required to stock two separate nozzles and two separate corresponding consumables, for example two retaining caps. However, the nozzles 205, 260 and retaining cap of FIGS. 2A and 2B allow the operator to stock two nozzles and only a single corresponding consumable, for example a retaining cap. When the operator switches between two separate plasma arc torch operating parameters, for example, between a current of 65 Amps and a current of 105 Amps, the operator can only change the nozzle, for example, replace the nozzle of FIG. 2A with the nozzle of FIG. 2B. The operator does not have to change the corresponding consumable. This decreases the amount of consumables that are used in a single plasma arc torch system and also decreases the chance that the consumables will be incorrectly matched.

Figure 2C:
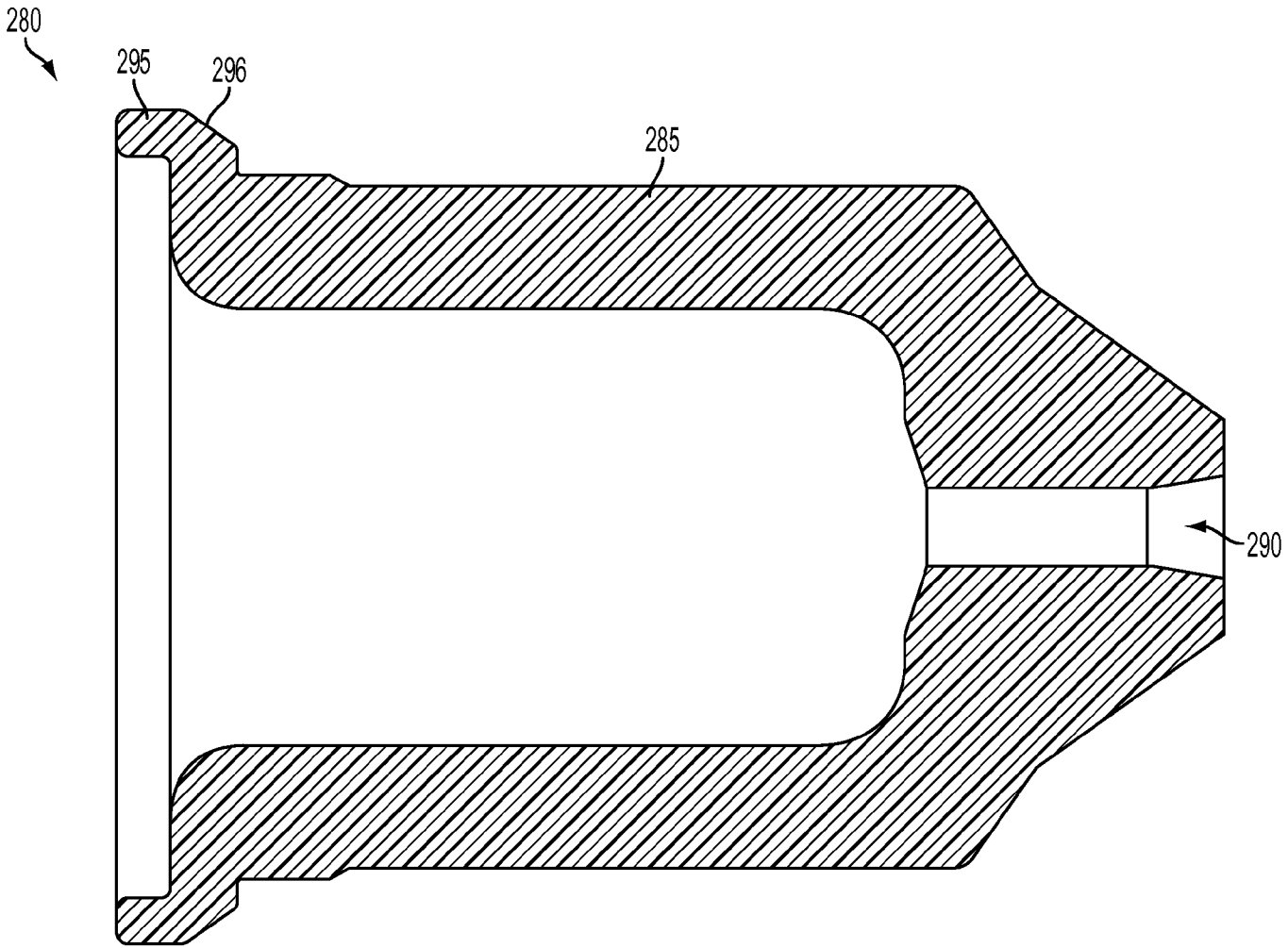
FIG. 2C is a cross sectional view of a nozzle, according to an illustrative embodiment of the invention.

FIG. 2C shows a cross sectional view of a nozzle 280, according to an illustrative embodiment of the invention. The nozzle 280 includes a nozzle body 285, a plasma exit orifice 290 and a flange 295. The flange 295 is similar to the flange 265 of FIG. 2B. The flange 295 is configured to selectively adjust the gas flow through gas passages of a corresponding consumable. For example, as shown in FIG. 2C, the flange 295 includes a tapered surface 296 that is adapted to contact a mating surface of a corresponding consumable.

Figure 3A:
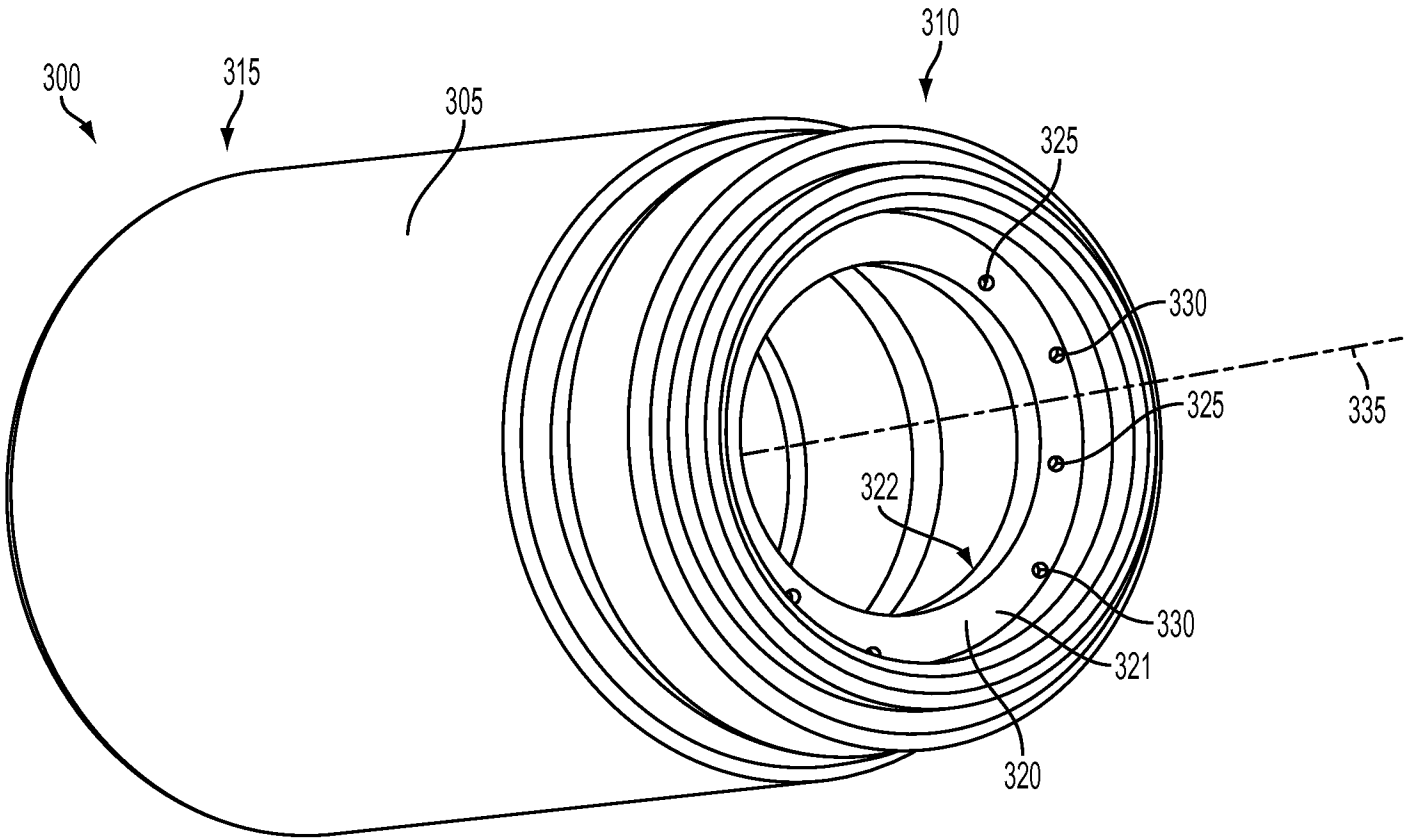
FIG. 3A is a perspective view of a nozzle retaining cap, according to an illustrative embodiment of the invention.

FIG. 3A shows a perspective view of a nozzle retaining cap 300, according to an illustrative embodiment of the invention. The nozzle retaining cap 300 includes a hollow body 305 having a first end 310 and a second end 315. A protrusion 320 is located at the first end 310 of the hollow body 305. The protrusion 320 has a first surface 321 and a second surface 322. The first surface 321 is on one side of the protrusion 320 and the second surface 322 is on an opposite side of the protrusion 320. A first hole pattern 325 is formed in the protrusion 320. A second hole pattern 330 is also formed in the protrusion 320. At least one of the holes of the first or second hole patterns 325, 330 are sized to control at least one of a nozzle cooling gas flow or a plasma gas flow.

As shown in FIG. 3A, the first and second hole patterns 325, 330 can form concentric circles. In some embodiments, the first hole pattern 325 has a first diameter relative to a central longitudinal axis 335. The central longitudinal axis 335 extends through the hollow body 305 of the retaining cap 300. The second hole pattern 330 can have a second diameter relative to the central longitudinal axis 335. For example the first diameter can be about 0.590 inches and the second diameter can be about 0.653 inches.

The first and second hole patterns 325, 330 can form any pattern, and can have a variety of sizes, to control at least one of a nozzle cooling gas flow or a shield gas flow. In some embodiments, the first hole pattern 325 and the second hole pattern 330 have the same number of gas passages. For example, each hole pattern 325, 330 can have about 2 to about 50 gas passages. In some embodiments, the first hole pattern 325 and the second hole pattern 330 have a different number of gas passages. For example, the first hole pattern 325 can have about 4 gas passages and the second hole pattern 330 can have about 6 gas passages.

The second surface 322 of the protrusion 320 can be configured to receive a flange disposed on the body of a nozzle. The flange can be sized to block the gas from flowing through one of the first or second hole patterns 325, 330. For example, the flange can be the flange 230 of FIG. 2A or the flange 265 of FIG. 2B. In some embodiments, the flange of the nozzle, for example flange 230 of FIG. 2A, is sized to allow the gas to flow through at least the second hole pattern 330 to cool the nozzle. In some embodiments, the flange of the nozzle, for example the flange 265 of FIG. 2B, is sized to allow the gas to flow through the first and second hole patterns to cool the nozzle.

Referring to FIG. 3A, in some embodiments, the second surface 322 is configured to receive a flange that is disposed on the body of a nozzle and the flange is sized to operate the plasma arc torch at a corresponding cutting parameter. For example, the cutting parameter can be a current, a cutting type (e.g., gouging or fine cutting), or a gag setting (e.g., a shield gas or a plasma gas setting).

Figure 3B:
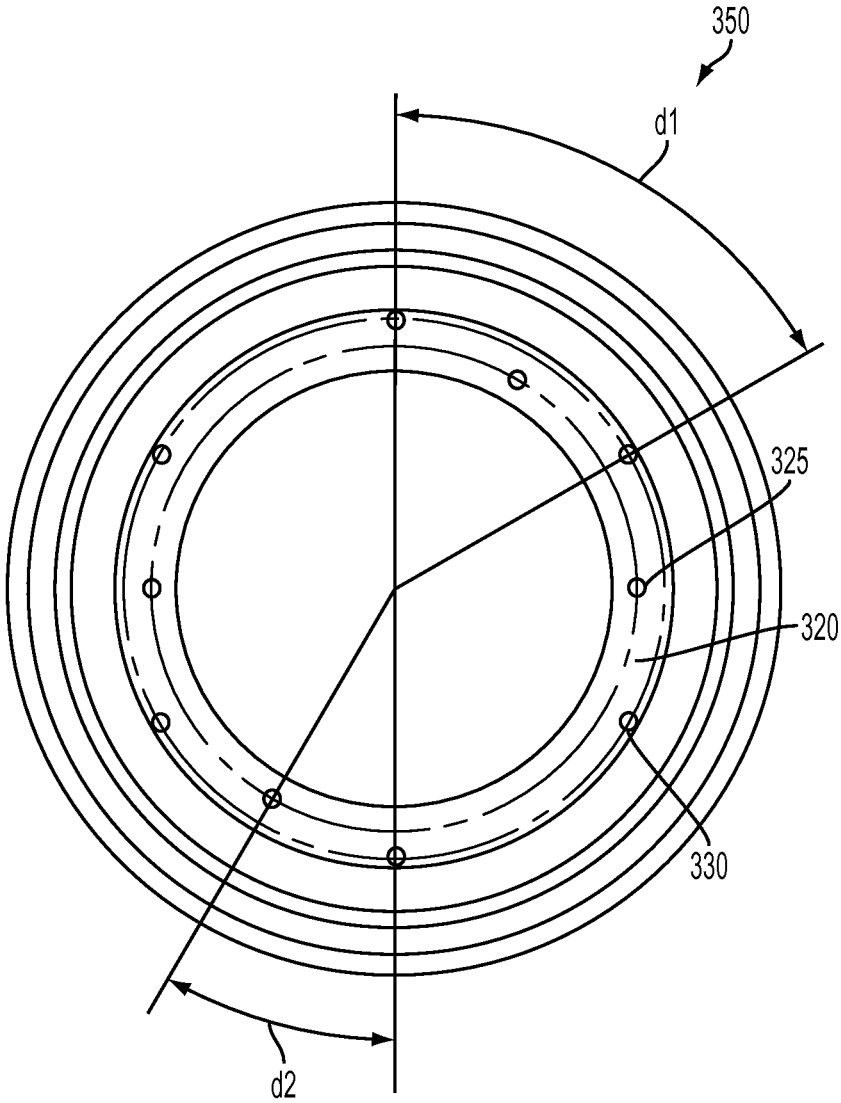
FIG. 3B is a schematic illustration of a nozzle retaining cap, according to an illustrative embodiment of the invention.

FIG. 3B shows a schematic illustration of a nozzle retaining cap 350, according to an illustrative embodiment of the invention. The first and second hole patterns 325, 330 are distributed in two concentric circles around the surface of the retaining cap 350. The angle between two gas passages of the first hole pattern or two gas passages of the second hole pattern d1 can be about 60°. The angle between a gas passage of the first hole pattern and a gas passage of a second hole pattern d2 can be about 30°.

As shown in FIG. 3B, the gas passages of the first hole pattern 325 and the second hole pattern 330 are staggered. In some embodiments, the gas passages of the first hole pattern 325 and the second hole pattern 330 are not staggered or are staggered at a distance of greater than or less than about 30°. In some embodiments, as shown in FIG. 3B, the first hole pattern 325 and the second hole pattern 330 are symmetrically aligned around the surface of the retaining cap. Symmetric alignment can allow for greater control and stability of the shield gas flow than if the first and second hole patterns 325, 330 were not symmetrically aligned.

In some embodiments, the size of the gas passages in the first and second hole patterns 325, 330 are the same. For example, the gas passages can have a diameter of about Ø0.018 inches to about Ø0.032 inches. In some embodiments, the gas passages have a diameter of about Ø0.021 inches. In some embodiments, the size of the gas passages varies for the two hole patterns. For example, the size of the gas passages within the first hole pattern can be smaller or larger than the size of the gas passages within the second hole pattern. In addition, the shape of the gas passages, the number of gas passages and/or the tangential angle of the gas passages of the retaining cap can vary between hole patterns. For example, the number of holes or gas passages within the first hole pattern can be greater than the number of holes or gas passages within the second hole pattern, or vice versa.

In some embodiments, the retaining cap can include additional hole patterns, for example, the retaining cap can have three or four hole patterns. These additional hole patterns can also be arranged in concentric circles around a central longitudinal axis of the retaining cap. The additional hole patterns can be symmetrically arranged around the protrusion of the retaining cap.

The retaining cap of FIGS. 3A and 3B can be a common part for a variety of different operating conditions. For example, the number of gas passages required to operate (e.g., cool a nozzle) a plasma arc torch at 65 Amps is less than the number of gas passages that are required to operate a plasma arc torch at 105 Amps. The retaining cap of FIGS. 3A and 3B can provide different gas flow rates when mated with different nozzles (e.g., the nozzles of FIGS. 2A and 2B). For example, the first hole pattern 325 can be blocked or exposed by a mating nozzle. The first hole pattern 325 can be located on an inner concentric circle of the protrusion 320 and the second hole pattern 330 can be located on an outer concentric circle of the protrusion 320. The nozzle of FIG. 2A can be used to block the first hole pattern 325 while leaving the second hole pattern 330 open for gas to flow through and cool the nozzle. The nozzle of FIG. 2B can be used to allow gas to flow through both the first and second hole patterns 325, 330 to cool the nozzle.

Figure 4A:
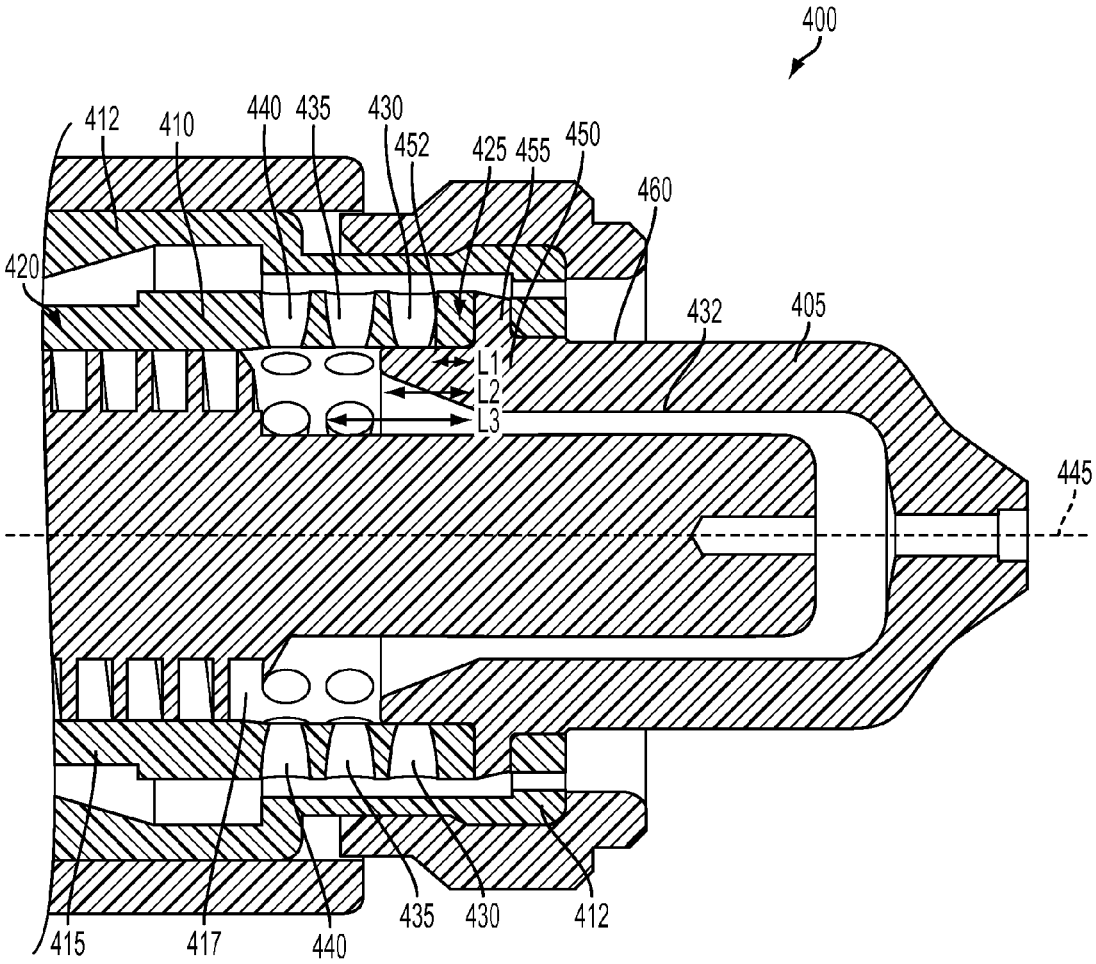
FIG. 4A is a cross-sectional view of a torch tip, including a nozzle and a swirl ring, according to an illustrative embodiment of the invention

FIG. 4A shows a cross-sectional view of a torch tip 400 including a nozzle 405 and a swirl ring 410, according to an illustrative embodiment of the invention. The torch tip 400 also includes a retaining cap 412. The swirl ring 410 includes a hollow body 415 that has a wall 417, a first end 420, and a second end 425. An opening is formed in the second end 425 of the hollow body 415 for mating with a nozzle 405 within the plasma arc torch. A first hole pattern 430 is formed in the wall 417 of the hollow body 415. The first hole pattern 430 is positioned and sized to provide a first gas flow characteristic about a surface 432 of the nozzle 405. A second hole pattern 435 is formed in the wall 417 of the hollow body 415. The second hole pattern 435 is positioned and sized to provide a second gas flow characteristic about the surface 432 of the nozzle 405.

In some embodiments, the swirl ring 410 also includes a third hole pattern 440 formed in the wall 417 of the hollow body 415. The third hole pattern 440 is positioned and sized to provide a third gas flow characteristic about the surface 432 of the nozzle 405. A gas flow characteristic can be, for example, the strength of the gas flow (or swirl) around the nozzle surface, the angle at which the gas flows (or swirls) around the nozzle, or any other characteristic or movement of the gas flow around the nozzle.

In some embodiments, the first, second and third hole patterns 430, 435, 440 are positioned and sized to provide the first gas flow when the plasma arc torch is operating a first cutting parameter (e.g., a first current). For example, all three hole patterns can be open (e.g., not blocked by a nozzle flange) and gas can flow through all three hole patterns. The second and third hole patterns 435, 440 can be positioned and sized to provide the second gas flow when the plasma arc torch is operating at a second cutting parameter (e.g., a second current). For example, only two of the three hole patterns can be open (e.g., the first hole pattern 430 can be blocked by a nozzle flange) and gas can flow through the second and third hole patterns 435, 440. In some embodiments, a third hole pattern 440 is positioned and sized to provide a third gas flow when the plasma arc torch is operating a third cutting parameter (e.g., a third current). For example, only one of the three hole patterns is open (e.g., the first and second hole patterns 430, 435 can be blocked by a nozzle flange) and the gas can flow through the third hole pattern 440.

The swirl ring can include more than three hole patterns. The first hole pattern 430 can be the same as the second hole pattern 435. For example, the first hole pattern 430 can have the same number and size of holes as the second hole pattern 435. In some embodiments, the third hole pattern 440 is also the same and the first and second hole patterns 430, 435.

Figure 4B:
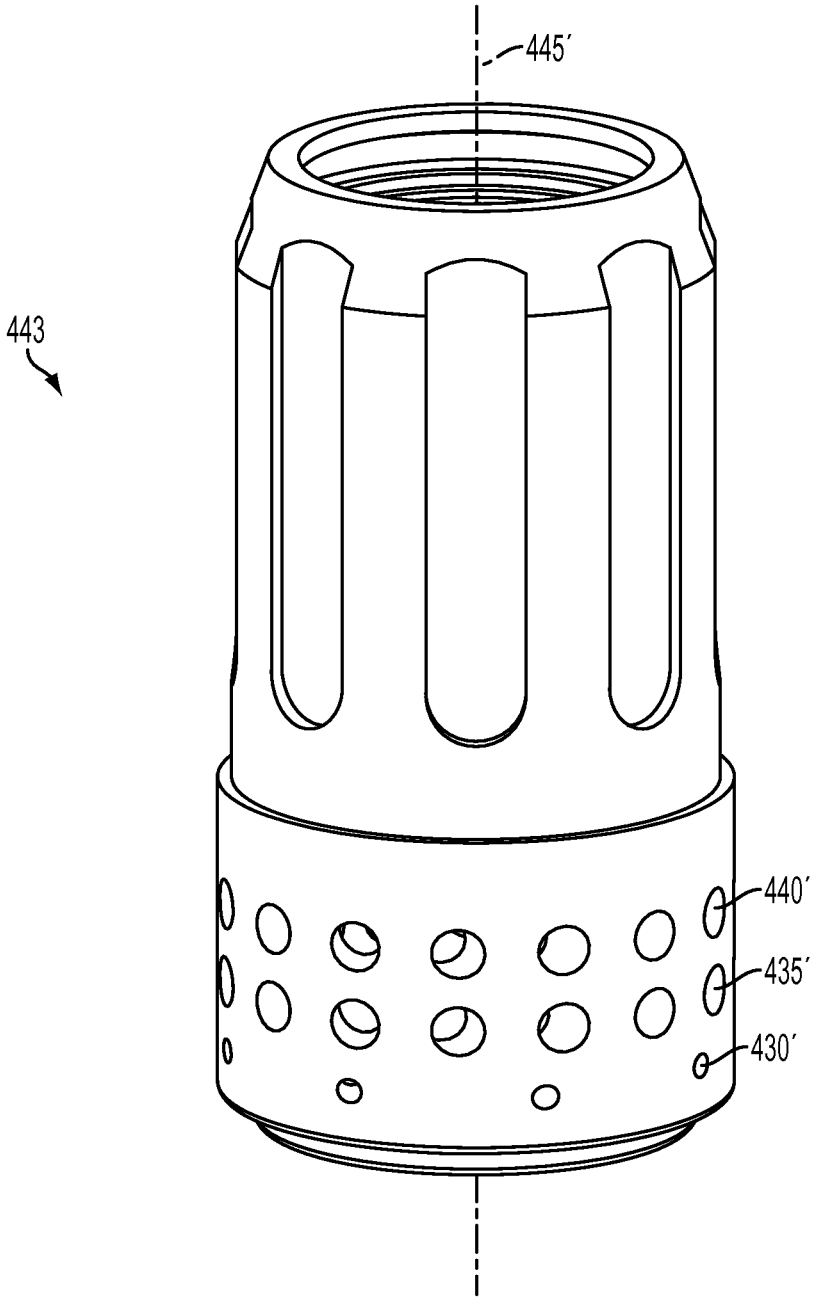
FIG. 4B is a side view of a swirl ring, according to an illustrative embodiment of the invention.

FIG. 4B shows a swirl ring 443 that has varying hole patterns. The first hole pattern 430' can differ from the second and/or third hole patterns 435', 440'. For example, the first hole pattern 430' can differ from the second hole pattern 435' in at least one of a size of the holes, a shape of the holes, a number of holes, or a tangential angle of the holes. As shown in FIG. 4B, the first hole pattern 430' can have a different number of gas passages or holes than the second hole pattern 435'. For example, the first hole pattern 430' can have about four gas passages and the second hole pattern 435' can have about six gas passages. In some embodiments, the first hole pattern 430' has more gas passages than the second hole pattern 435'. The gas passages of the first, second, and/or third hole patterns 43'0, 435', 440' can be arranged symmetrically around a central longitudinal axis 445'.

Referring to FIG. 4A, the opening of the swirl ring 410 can be configured to receive a nozzle 405 having a flange 450. The flange 450 can be an extension 452 that is axially disposed relative to a longitudinal axis 445 extending through the nozzle body. The extension 452 can be dimensioned to correspond to (e.g., block) the first hole pattern 430 of the swirl ring 410. In some embodiments, the opening of the swirl ring 410 is configured to receive a first nozzle having a first extension (e.g., the nozzle 405 and extension 452 shown in FIG. 4) or a second nozzle having a second extension (not shown). The first extension of the first nozzle can be dimensioned to correspond to the first hole pattern 430 and the second extension of the second nozzle can be dimensioned to correspond to the first and second hole patterns 430, 435. For example, the second extension can be longer than the first extension to correspond to the first and second hole patterns 430, 435.

The extension 452 can regulate a plasma gas flow about an interior surface 432 of the nozzle body. Regulation or adjustment of the plasma gas flow can help stabilize the arc. Stabilization of the arc can increase the performance of the plasma arc torch and reduce the chance of premature consumable damage. As shown in FIG. 4A, the nozzle 405 can have an extension 452 and a step 455. The extension 452 can regulate the plasma gas flow about the interior surface 432 of the nozzle body while the step 455 can regulate the shield gas flow about an exterior surface 460 of the nozzle body. The step 455 can regulate the shield gas flow similar to that described with reference to FIGS. 2A and 2B.

In some embodiments, a flange 450 disposed on a body of the nozzle 405 is sized to block a gas flow through the second hole pattern 435. A flange 450 disposed on a body of the nozzle 405 can be sized to allow a gas to flow through at least the second hole pattern 435. The flange can be sized to allow the gas to flow through the first and second hole patterns 430, 435.

The length of the extension 452 can be adjusted and/or sized to block hole patterns. For example, a length L1 of the extension 452 can allow gas to flow through all three hole patterns 430, 435, 440. In some embodiments, the nozzle does not have to have an extension, which would also allow gas to flow through all hole patterns. Increasing the length of the extension 452 can cause the extension 542 to block hole patterns to change the flow rate of the gas. For example, a length L2 of the extension 452 blocks the first hole pattern 430. Increasing the length of the extension increases the number of hole patterns the extension can block. For example, a length L3 of the extension 452 can block the first and second hole patterns 430, 435. Any number of hole patterns and corresponding lengths of the extension can be used. The length of the extension can range from about 0.08 inches to about 0.25 inches.

The number of hole patterns and/or number of gas passages within the hole patterns that are opened or blocked affects the strength or intensity of swirl. Referring to FIG. 4A, the nozzle 405 blocks one hole pattern, e.g., the first hole pattern 430. The strength or intensity of the swirl with one hole pattern blocked is less than the strength or intensity of the swirl with two or more hole patterns blocked. Swirl strength has a negative effect of electrode life and a positive effect on arc stability. The swirl strength can be tuned for various processes by blocking the relevant hole pattern(s) of the swirl ring.

For example, a swirl ring can have a uniform set of gas passages (e.g., the gas passages have the same size holes with the same offsets) in four rows of ten gas passages per row (e.g., 40 total gas passages). If a flange of a nozzle selectively blocks two out of the four rows (e.g., 20 gas passages are blocked, or 50%), the velocity and swirl strength of the plasma gas is about doubled compared to a swirl ring that has all four rows open (e.g., 0 gas passages are blocked). The velocity and swirl strength are thus approximately proportional to the percentage of blocked passages.

As shown in FIGS. 2A, 2B, and 4A, the flange/extension blocks the entire gas passage and not a portion of a gas passage. The gas passages are small, having a diameter of about 0.018 inches to about 0.1 inches. To partially block a gas passage, the tolerance required in the manufacturing of the flange/extension is very tight and not practical to manufacture. A small change in the size, shape, contour, and/or length of the flange and/or extension can greatly change the flow characteristics of the plasma gas and/or shield gas. This could lead to decreased stability of the plasma arc or insufficient cooling of the nozzle. Therefore, the flange/extension can block an entire gas passage of the consumable (e.g., a retaining cap or a swirl ring) and not a portion of a gas passage.

Figure 5:
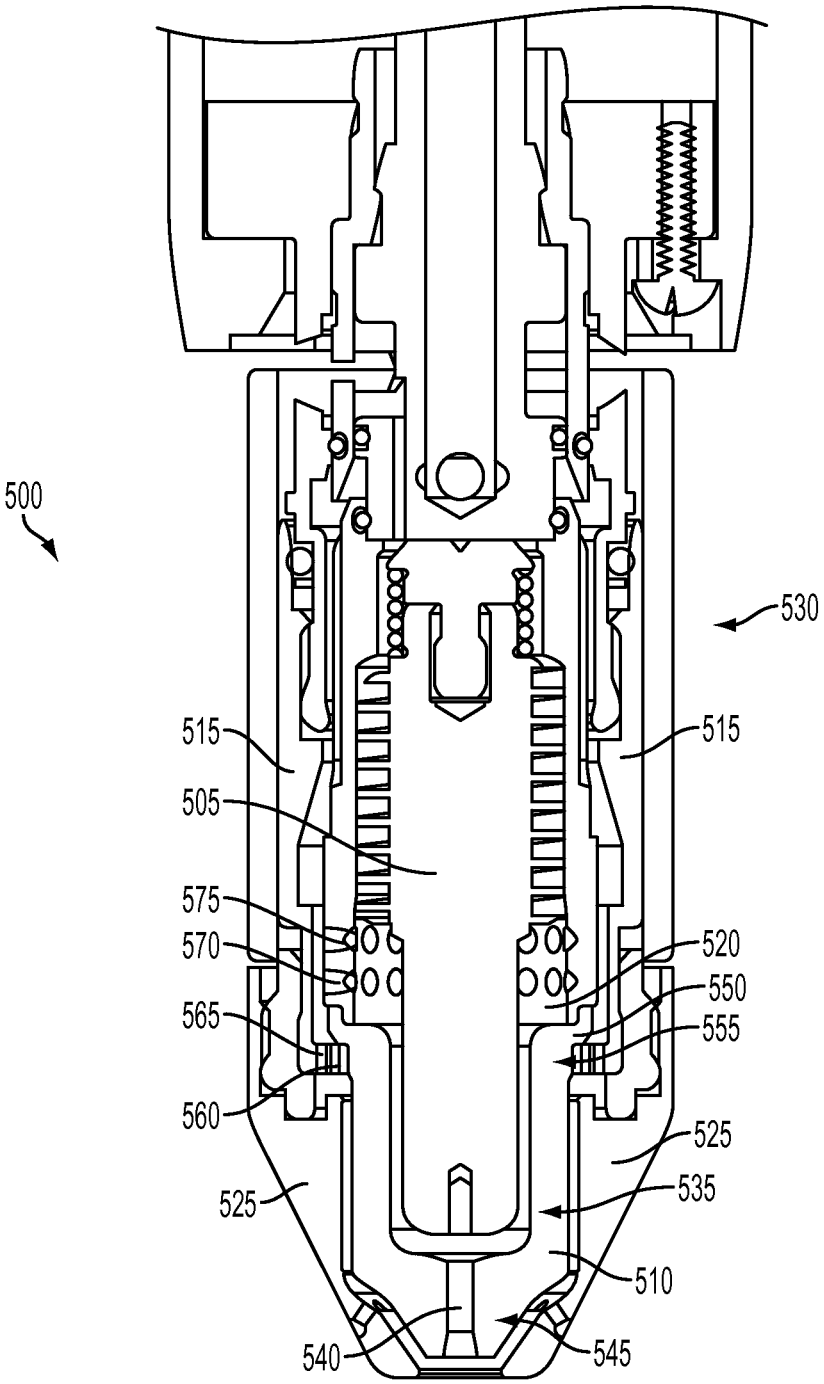
FIG. 5 is a cross sectional view of a torch tip, according to an illustrative embodiment of the invention.

FIG. 5 shows a cross sectional view of a torch tip 500, according to an illustrative embodiment of the invention. Similar to FIG. 1, the torch tip includes an electrode 505, a nozzle 510, a retaining cap 515, a swirl ring 520, and a shield 525. The nozzle 510 is mounted in a torch body 530 of the plasma arc torch. The nozzle comprises a nozzle body 535, a plasma exit orifice 540 at a first end 545 of the nozzle body 535, and a flange 550 at a second end 555 of the nozzle body 535. The torch tip also includes a consumable (e.g., the retaining cap 515 or the swirl ring 520). The consumable is adapted to mate with the flange 550 of the nozzle. The consumable has a surface at one end. The surface includes a first hole pattern and a second hole pattern. The holes within at least one of the first or second hole patterns are sized to control at least one of a nozzle cooling gas flow or a plasma gas flow. The first and second hole patterns can be the first and second hole patterns 560, 565 of the retaining cap 515 and/or the first and second hole patterns 570, 575 of the swirl ring 520.

Although the nozzle shown in FIG. 5, is similar to the nozzle of FIG. 2B, the nozzle can be the nozzle of FIG. 2A, FIG. 2B, FIG. 2C, or FIG. 4A. The nozzle can include any of the specific embodiments discussed herein. The retaining cap and swirl ring can also be the retaining cap and/or swirl ring of FIG. 3A, FIG. 3B, FIG. 4A or FIG. 4B. The consumables that are used can also be any other plasma arc torch consumable. The type of consumables that are used (e.g., nozzle, retaining cap, and/or swirl ring) can depend on the cutting parameters or specific flow characteristics that are needed.

As described herein, the invention decreases the number of consumables that are used within a plasma arc torch. A single retaining cap and/or swirl ring can be used for a variety of different cutting parameters and/or flow characteristics, respectively. Therefore, the operator can change the nozzle without having to also change the retaining cap and/or swirl ring when changing cutting parameters or flow characteristics of the plasma arc torch.

Figure 6:
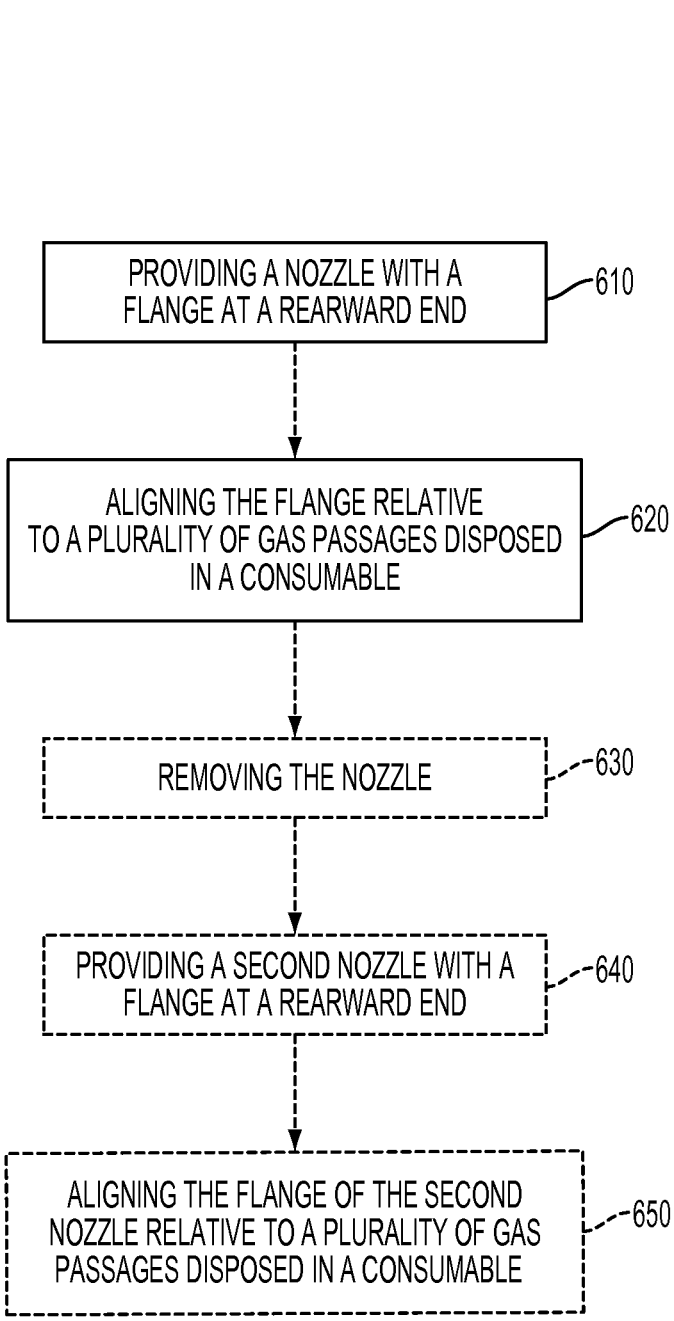
FIG. 6 is a flow chart of a method of establishing a gas flow in a plasma arc torch, according to an illustrative embodiment of the invention.

FIG. 6 shows a flow chart 600 of a method of establishing a gas flow in a plasma arc torch, according to an illustrative embodiment of the invention. The method includes providing a nozzle having a flange at a rearward end of the nozzle (step 610). The nozzle has a body with an inner and an outer surface. The nozzle also has a plasma exit orifice at a forward end the body. The nozzle can be any of the nozzles described above, for example, the nozzle of FIG. 2A, FIG. 2B, FIG. 2C, or FIG. 4A.

The method also includes aligning the flange relative to a plurality of gas passages disposed on a consumable (step 620). The flange is aligned (step 620) such that the flange selectively blocks at least one gas passage to thereby establish a gas flow along at least one of the inner or the outer surface of the nozzle body.

The consumable can be a retaining cap. For example, the retaining cap has a plurality of gas passages extending therethrough for providing the shield with a gas flow. The retaining cap can be, for example, the retaining cap described in FIG. 3A or FIG. 3B. When the consumable is a retaining cap, the flange can be a radial flange, and the flange can be selectively sized to establish a shield gas flow along the outer surface of the nozzle. The flange can selectively block either a first or a second hole pattern.

The consumable can also be a swirl ring, for example, the swirl ring of FIG. 4. When the consumable is a swirl ring, the flange can be an axial flange, and the flange can be selectively sized to establish a plasma gas flow along the interior surface of the nozzle.

The method can optionally include removing the nozzle (step 630) from the plasma arc torch. In some embodiments, the method also includes providing a second nozzle with a flange at the rearward end (step 640). The second nozzle includes an outer surface, a plasma exit orifice at a forward end and a flange at a rearward end. In some embodiments, the second nozzle also includes an inner surface. The flange of the second nozzle is different than the flange of the nozzle. For example, the flange of the second nozzle can have a different contour, size, and/or shape than the nozzle.

The flange of the second nozzle can be aligned relative to a plurality of gas passages disposed in a consumable (step 650). The consumable can be, for example, a retaining cap or a swirl ring. The flange of the second nozzle blocks at least two gas passages disposed in the consumable to establish a second gas flow along at least one of the inner or the outer surface of the nozzle body. The gas flow established by the second nozzle is different than the gas flow established by the first nozzle.

For example, when the consumable is a retaining cap, the gas flow established by the nozzle is a shield gas flow around an exterior surface of the nozzle. When the second nozzle is used, the shield gas flow can be less than when the nozzle is used. For example, an operator can operate a plasma arc torch at 105 Amps using the retaining cap of FIG. 3A or FIG. 3B and the nozzle of FIG. 2B or FIG. 2C. The nozzle allows gas to flow through two hole patterns (e.g., the first and second hole patterns 235, 236 of FIG. 2B). The operator can then switch to a different operating parameter, for example, the operator can operate the same plasma arc torch at 85 Amps. When the plasma arc torch is operated at 85 Amps, less gas is required to cool the nozzle. Therefore, the operator can remove the first nozzle, and replace it with a second nozzle. The second nozzle can be, for example, the nozzle of FIG. 2A. The remaining consumables within the plasma arc torch remain the same, include the retaining cap. The nozzle can now block at least one hole pattern, for example, the first hole pattern 235 of FIG. 2A. The nozzle adjusts the gas flow to only flow through a single hole pattern, for example, the second hole pattern 236 of FIG. 2B. Less gas flows through the retaining cap to the exterior surface of the nozzle than using the nozzle of FIG. 2B or FIG. 2C.

For example, a plasma arc torch can operate with an upstream pressure of about 60 psi. Different flow rates of the shield gas are required to operate a plasma arc torch at 85 Amps and 105 Amps. The flow rate difference between the 105 Amps and 85 Amp configuration is about 100 standard cubic feet per hour ("scfh"). This flow rate difference provides better cooling of the nozzle and/or shield when the plasma arc torch is operated at 105 Amps and also reduces the amount of shield gas that is consumed when the plasma arc torch is operated at 85 Amps.

In some embodiments, the consumable, e.g., a retaining cap or swirl ring, has more than two hole patterns, for example, three, four, or five hole patterns. The flange of a nozzle can be sized to block any of the hole patterns. The flange can be sized to block at least two hole patterns.

The gas passages do not have to be arranged in patterns. The consumable can have a plurality of gas passages that are not arranged in any type of pattern. The flange of the nozzle can be sized to block a single gas passage or a plurality of gas passages. The number of gas passages that are blocked can depend on the cutting parameter or the flow characteristic that is desired for a specific project.

Although various aspects of the disclosed method have been shown and described, modifications may occur to those skilled in the art upon reading the specification. The present application includes such modifications and is limited only by the scope of the claims.

What is claimed is:

1. A nozzle for a plasma arc torch comprising:
a body having a first end and a second end;
a plasma exit orifice at the first end of the body; and
a flange at the second end of the body adapted to align the nozzle with respect to a longitudinal axis of the torch, the flange configured to selectively adjust a shield gas flow entering at least one gas passage in a corresponding consumable, without completely blocking the at least one gas passage, to prevent the shield gas flow from entering the at least one gas passage and to cool an exterior surface of the nozzle body by regulating the shield gas flow.

2. The nozzle of claim 1 wherein the flange comprises at least one of a contoured, tapered or castellated surface adapted to mate with a mating surface of the corresponding consumable.

3. The nozzle of claim 1 wherein the flange is radially disposed relative to a longitudinal axis extending through the nozzle body.

4. The nozzle of claim 1 wherein the flange is selectively contoured to regulate at least one of a shield gas flow about an exterior surface of the nozzle body or a plasma gas flow about an interior surface of the nozzle body.

5. The nozzle of claim 1 wherein the flange forms a step disposed relative to an exterior surface of the nozzle and radially disposed relative to a longitudinal axis extending through the nozzle body, wherein the step regulates a shield gas flow about an exterior surface of the nozzle body.

6. The nozzle of claim 1 wherein the corresponding consumable is one of a swirl ring or a retaining cap.

7. The nozzle of claim 1 wherein the flange is configured to selectively adjust the shield gas flow by blocking at least one gas passage in the corresponding consumable.

8. The nozzle of claim 1 wherein the flange is an extension axially disposed relative to a longitudinal axis extending through the nozzle body, wherein the extension regulates a plasma gas flow about an interior surface of the nozzle body.

9. The nozzle of claim 8 further comprising a step disposed relative to an exterior surface of the nozzle and radially disposed relative to a longitudinal axis extending through the nozzle body wherein the step regulates a shield gas flow about an exterior surface of the nozzle body.

10. A nozzle retaining cap configured to maintain a nozzle within a plasma arc torch, the nozzle retaining cap comprising:
a hollow body having a first end and a second end;
a protrusion located at the first end of the hollow body;
a first hole pattern formed in the protrusion; and
a second hole pattern formed in the protrusion, wherein holes within at least one of the first or second hole patterns are sized to control at least one of a nozzle cooling gas flow or a plasma gas flow;
wherein the nozzle for the plasma arc torch comprises:
a nozzle body having a first end and a second end;
a plasma exit orifice at the first end of the nozzle body; and
a flange at the second end of the nozzle body adapted to mate with a corresponding consumable, the flange configured to selectively block at least one gas passage in the corresponding consumable to establish a gas flow relative to the nozzle body.

11. The nozzle retaining cap of claim 10 wherein the first hole pattern has a first diameter relative to a central longitudinal axis extending through the body and the second hole pattern has a second diameter relative to the central longitudinal axis extending through the body.

12. The nozzle retaining cap of claim 10 wherein the first hole pattern has a first diameter relative to a central longitudinal axis extending through the hollow body and the second hole pattern has a second diameter relative to the central longitudinal axis extending through the hollow body.

13. The nozzle retaining cap of claim 10 wherein a surface of the protrusion is configured to receive the flange disposed on the body of the nozzle, the flange sized to block the gas from flowing through one of the first or second hole patterns.

14. The nozzle retaining cap of claim 10 wherein a surface of the protrusion is configured to receive the flange disposed on the body of the nozzle, the flange sized to allow the gas to flow through the first and second hole patterns to cool the nozzle.

15. The nozzle retaining cap of claim 10 wherein a surface of the protrusion is configured to receive the flange disposed on the body of the nozzle, the flange sized to operate the plasma arc torch at a corresponding cutting parameter.

16. The nozzle retaining cap of claim 10 wherein the first hole pattern has the same number of gas passages as the second hole pattern.

17. The nozzle retaining cap of claim 10 wherein the first hole pattern has a different number of gas passages as the second hole pattern.

18. The nozzle retaining cap of claim 10 wherein the first hole pattern differs from the second hole pattern in at least one of a size of the holes, a shape of the holes, a number of holes, or a tangential angle of the holes.

19. The nozzle retaining cap of claim 10 wherein the first hole pattern and the second hole pattern are concentric circles.

20. A plasma arc torch tip comprising:
a nozzle comprising:
a body having a first end and a second end;
a plasma exit orifice at the first end of the nozzle body; and
a flange at the second end of the nozzle body adapted to mate with a corresponding consumable, the flange configured to selectively block at least one gas passage in the corresponding consumable to establish a gas flow relative to the nozzle body;
wherein the nozzle is mounted in a torch body of the plasma-arc torch; and
the consumable is adapted to mate with the flange of the nozzle, the consumable having a surface at one end, the surface having a first hole pattern and a second hole pattern, wherein holes within at least one of the first or second hole patterns are sized to control at least one of a nozzle cooling gas flow or a plasma gas flow.

21. The torch tip of claim 20 wherein the flange forms an extension axially disposed relative to a longitudinal axis extending through the nozzle body, wherein the extension regulates a plasma gas flow about an interior surface of the nozzle body.

22. The torch tip of claim 20 wherein the consumable is one of a swirl ring or a retaining cap.

23. The torch tip of claim 20 wherein the flange forms a step disposed relative to an exterior surface of the nozzle and radially disposed relative to a longitudinal axis extending through the nozzle body, wherein the step regulates a shield gas flow about an exterior surface of the nozzle body.

24. A plasma arc torch swirl ring comprising:

a hollow body having a wall, a first end and a second end;

an opening formed in the second end of the hollow body for mating with a nozzle of a plasma arc torch;

a first hole pattern formed in the wall of the hollow body, wherein the first hole pattern is positioned and sized to provide a first gas flow characteristic about a surface of the nozzle; and a second hole pattern formed in the wall of the body, wherein the second hole pattern is positioned and sized to provide a second gas flow characteristic about the surface of the nozzle;

wherein the swirl ring is configured to receive the nozzle of the plasma arc torch, the nozzle comprising:

a body having a first end and a second end;

a plasma exit orifice at the first end of the nozzle body; and a flange at the second end of the nozzle body adapted to mate with a corresponding consumable, the flange configured to selectively block at least one gas passage in the corresponding consumable to establish a gas flow relative to the nozzle body.

25. The swirl ring of claim 24 wherein the first hole pattern differs from the second hole pattern in at least one of a size of the holes, a shape of the holes, a number of holes, or a tangential angle of the holes.

26. The swirl ring of claim 24 wherein the first hole pattern has a different number of gas passages as the second hole pattern.

27. The swirl ring of claim 24 wherein the flange disposed on the body of the nozzle is sized to block a gas flow through the second hole pattern.

28. The swirl ring of claim 24 wherein the first hole pattern is positioned and sized to provide the first gas flow when the plasma arc torch is operating at a first cutting parameter and the second hole pattern is positioned and sized to provide the second gas flow when the plasma arc torch is operating at a second cutting parameter.

29. The swirl ring of claim 24 further comprising a third hole pattern formed in the wall of the body, wherein the third hole pattern is positioned and sized to provide a third gas flow characteristic about the surface of the nozzle.

30. The swirl ring of claim 24 wherein the flange disposed on the body of the nozzle is sized to allow a gas to flow through at least the second hole pattern.

31. The swirl ring of claim 30 wherein the flange is sized to allow the gas to flow through the first and second hole patterns.

32. A plasma arc torch swirl ring comprising:

a hollow body having a wall, a first end and a second end;

an opening formed in the second end of the hollow body for mating with a nozzle of a plasma arc torch;

a first hole pattern formed in the wall of the hollow body, wherein the first hole pattern is positioned and sized to provide a first gas flow characteristic about a surface of the nozzle; and a second hole pattern formed in the wall of the body, wherein the second hole pattern is positioned and sized to provide a second gas flow characteristic about the surface of the nozzle;

wherein the opening is configured to receive a first nozzle having a first flange or a second nozzle having a second flange, wherein the first flange of the first nozzle is dimensioned to correspond to the first hole pattern and the second flange of the second nozzle is dimensioned to correspond to the first and second hole patterns.

33. A method of establishing a gas flow in a plasma arc torch, the method comprising:

providing a nozzle comprising: a body having a first end and a second end; a plasma exit orifice at the first end of the body; and a flange at the second end of the body adapted to align the nozzle with respect to a longitudinal axis of the torch, the flange configured to selectively adjust a shield gas flow entering at least one gas passage in a corresponding consumable, without completely blocking the at least one gas passage, to prevent the shield gas flow from entering the at least one gas passage and to cool an exterior surface of the nozzle body by regulating the shield gas flow; and aligning the flange of the nozzle relative to a plurality of gas passages of a consumable, such that the flange selectively blocks at least one gas passage to thereby establish a gas flow along at least one of the inner or the outer surface of the nozzle body.

34. The method of claim 33 wherein the flange is a radial flange, the consumable is a retaining cap and the gas flow is a shield gas flow.

35. The method of claim 33 wherein the flange is an axial flange, the consumable is a swirl ring and the gas flow is a plasma gas flow.

* * * * *